US005087079A

United States Patent [19]

Morris, Jr.

[11] Patent Number: 5,087,079

[45] Date of Patent: Feb. 11, 1992

[54] WATERTIGHT NOTE CARD ASSEMBLY

[76] Inventor: Daniel R. Morris, Jr., 5737 Northton Ct., Dale City, Va. 22193

[21] Appl. No.: 574,115

[22] Filed: Aug. 29, 1990

[51] Int. Cl.[5] ..... B41L 1/20

[52] U.S. Cl. ..... 462/8; 283/115; 273/176 L; 206/579

[58] Field of Search ..... 282/3, 22 X; 206/215, 206/579, 425; 273/176 L; 434/252; 283/115

[56] References Cited

U.S. PATENT DOCUMENTS 797,548 8/1905 Bates .
1,353,889 9/1920 Brown .
1,447,358 3/1923 Seguine .
2,333,597 11/1943 Strauss .
2,670,971 3/1954 Johnson ..... 282/22 X
4,331,425 5/1984 Davis .
4,448,445 5/1984 Chang .
4,729,506 3/1988 Neubauer .
4,746,045 5/1985 Schweim .

*Primary Examiner*—Timothy V. Eley
*Assistant Examiner*—Willmon Fridie, Jr.
*Attorney, Agent, or Firm*—Larson and Taylor

[57] ABSTRACT

Disclosed is a note card assembly that is watertight, yet accessible to remove a completed note card. In one embodiment the assembly has a generally rectangular shape in plan view and comprises a watertight envelope having an interior pocket defined by permanent seals on three sides and a resealable seal on the fourth side. A subassembly inside the pocket includes a layered sandwich of a rigid writing board, a note card having a CF coated top surface, and a transparent sheet having a CB coated bottom surface in contact with the top surface of the note card. When pressure is applied to the outer envelope, a chemical reaction takes place between the two coated layers leaving a permanent marking on the top surface of the note card.

20 Claims, 4 Drawing Sheets

WATERTIGHT NOTE CARD ASSEMBLY

BACKGROUND OF THE INVENTION

This invention relates to a waterproof or watertight note card assembly. More specifically, in a preferred embodiment, it relates to a note card assembly for sports games, such as golf, where the recording of data on the note card is necessary, and where the note card is likely to be exposed to moisture and the elements.

DESCRIPTION OF THE PRIOR ART

As is known, various devices have been proposed for recording data on a card. Generally these include recording media that is directly marked, such as paper note cards marked with a pencil, "erasable" plastic coated cards written on by non-permanent markers, and score recording cards and programs written on with pens and pencils used for sport games.

The known prior art also discloses the use of carbon paper and the like materials which can be marked with a non-recording stylus. In addition, it is known to use so-called non-carbon required or carbonless paper using a conventional CF (Coated Front) coating on one side on one paper and a conventional CB (Coated Back) coating on an abutting side of a second paper. For example, a U.S. patent to Neubauer, No. 4,729,506 discloses a non-waterproof mailer assembly comprised of a transparent CB coated window that lies against a CF coated paper. Writing with a stylus on the window results in legible indicia on the paper. The U.S. Chang Pat. No. 4,448,445 discloses another type of pressure sensitive record keeping assembly employing a translucent layer. The Strauss U.S. Pat. No. 2,333,597 discloses a writing tablet having a solid backing and an overlying transparent plastic layer.

The known prior art also discloses many varieties of score cards. Some examples of such score cards can be found in the following U.S. Pats.: Bates, U.S. Pat. No. 797,548; Brown U.S. Pat. No. 1,353,889; Seguine U.S. Pat. No. 1,447,358; and Davis U.S. Pat. No. 4,331,425.

However, none of these known prior art devices teaches the incorporation of a recording medium in a waterproof writing assembly. While these devices vary in many different aspects, none of them has solved the problem encountered by golf players and others who are exposed to dirt, rain and other adverse elements and who need to make permanent records in an adverse environment. To record safely a score on a score card in such circumstances, it is necessary that the score card be waterproof, and that the apparently contradictory requirements that the data be permanently recorded, visable and on a replaceable card also be satisfied.

SUMMARY OF THE INVENTION

Therefore, it is a primary object of the present invention to provide a note card assembly for achieving the above desired requisites of permanently recording data on a note card, in the rain and in other wet environments. The present invention provides a score recording card assembly that is waterproof, as well as one that has a permanently recorded, visible image on a changeable card.

It is also the object of the present invention to provide a note card assembly that is extremely inexpensive. Another objective is that the note card assembly should be extremely easy to use, be reusable and its record keeping element should be easy to replace. In particular, it is an object that the present invention provide a hand held record keeping assembly that can use a non-marking stylus to make a permanent marking.

It has been found that these objects can be achieved by providing a watertight envelope-like member having at least a portion of it transparent and further having a separate card assembly which is slidable into the envelope for recording data thereof. In a specific embodiment, the envelope has at least a front panel and a back panel, and a watertight seal permanently seals the edge portions of the front and back panels to define an interior pocket. The envelope has an opening in it so as to permit access into said pocket. A watertight resealable sealing means is provided along said opening. The envelope can have a square shape, an elongate or rectangular shape, and any other shape appropriate for the use as a note card. The card assembly has an appropriate dimension and shape so as to be slidably inserted into said pocket. The card assembly has a piece of carbon-back (CB) coated transparent glassine paper, a piece of carbon-front (CF) coated score card and a piece of rigid board. The CF coated card has permanently printed indicia thereof for recording score data.

These together with other objects and advantages which will become subsequently apparent reside in the details of construction and operation as more fully hereinafter described and claimed taken in conjunction with the accompanying drawings.

DESCRIPTION OF THE PREFERRED EMBODIMENT

Figure 1:
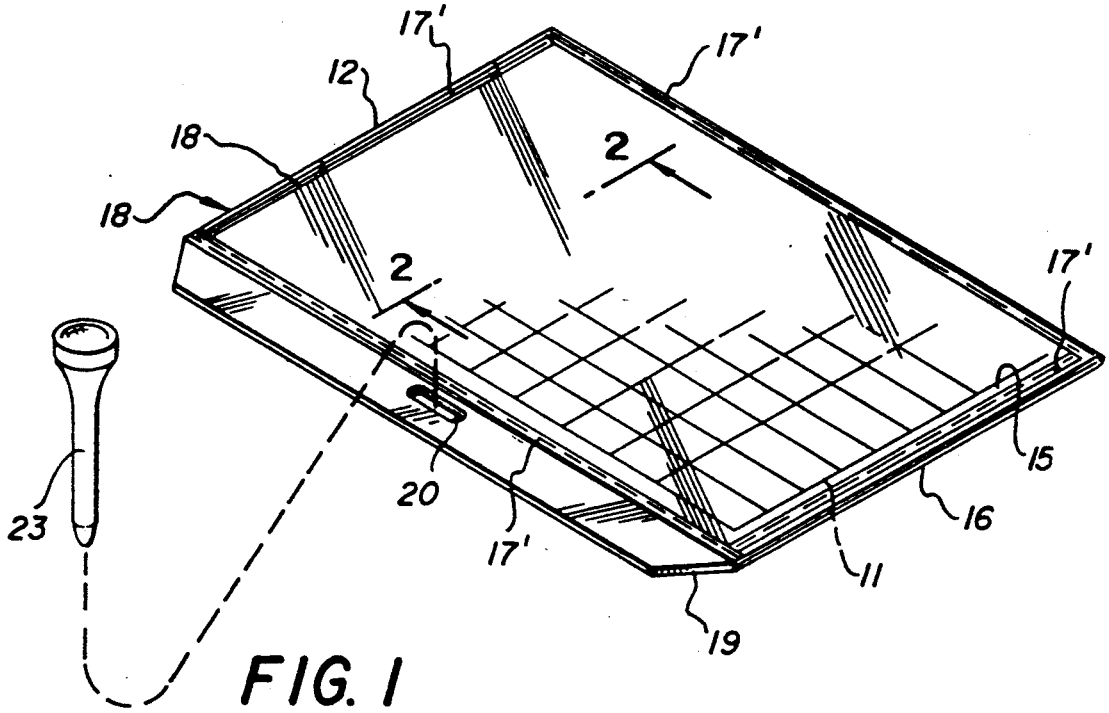
FIG. 1 is a perspective view of a first embodiment of a watertight note card assembly.

Referring now to the drawings in which like numerals refer to like elements throughout the several views, and specifically referring to FIG. 1, a watertight note card assembly in accordance with a presently preferred embodiment is generally designated by reference number 10. Note card assembly 10 is particularly adapted for use in scoring golf and includes a golf record or score card 11, and a rectangular, watertight, resealable envelope, generally designated by the number 12, which is adapted to receive card 11.

Figure 3:
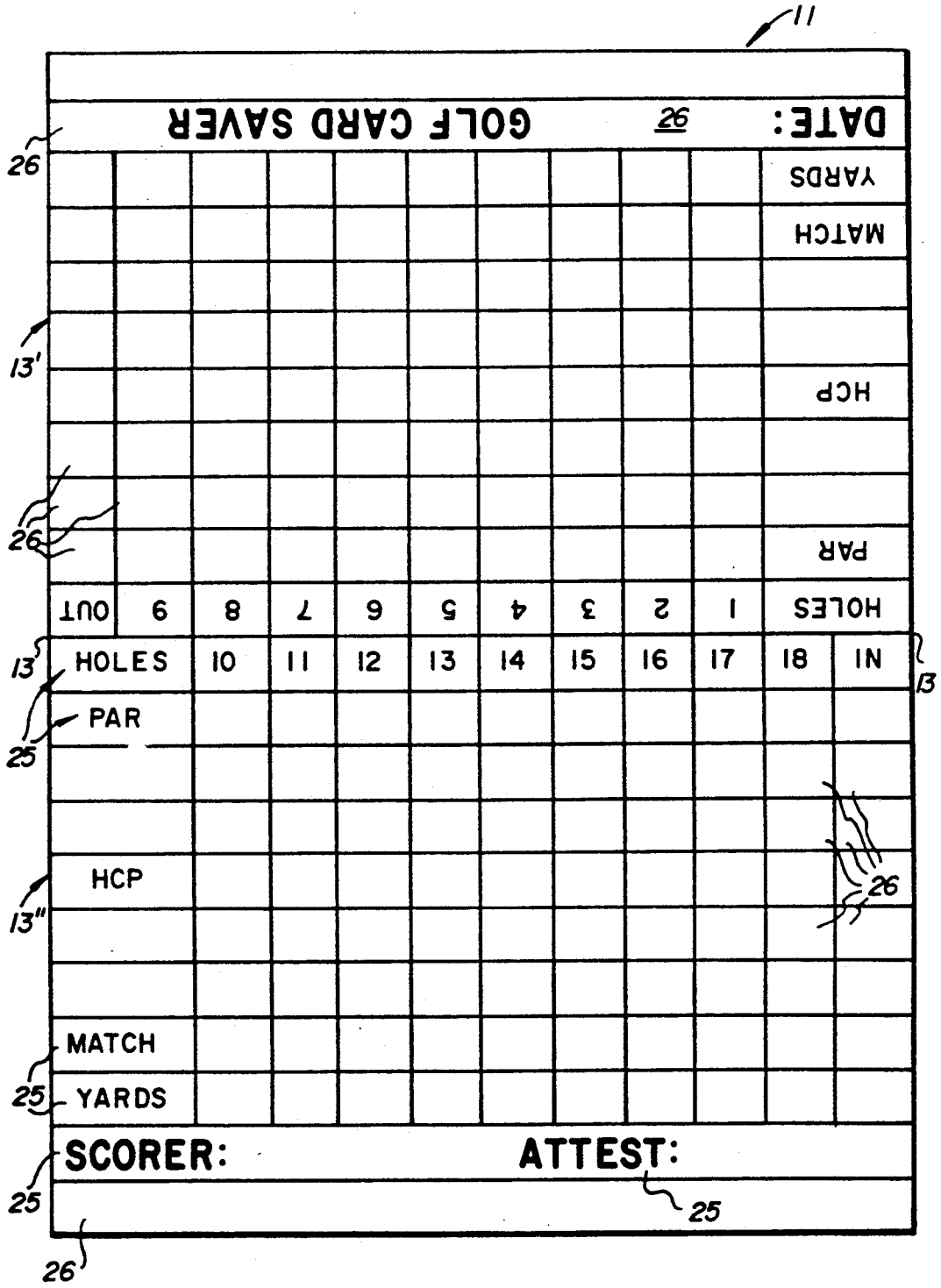
FIG. 3 is a plan view of a foldable, golf score record card.
Figure 4:
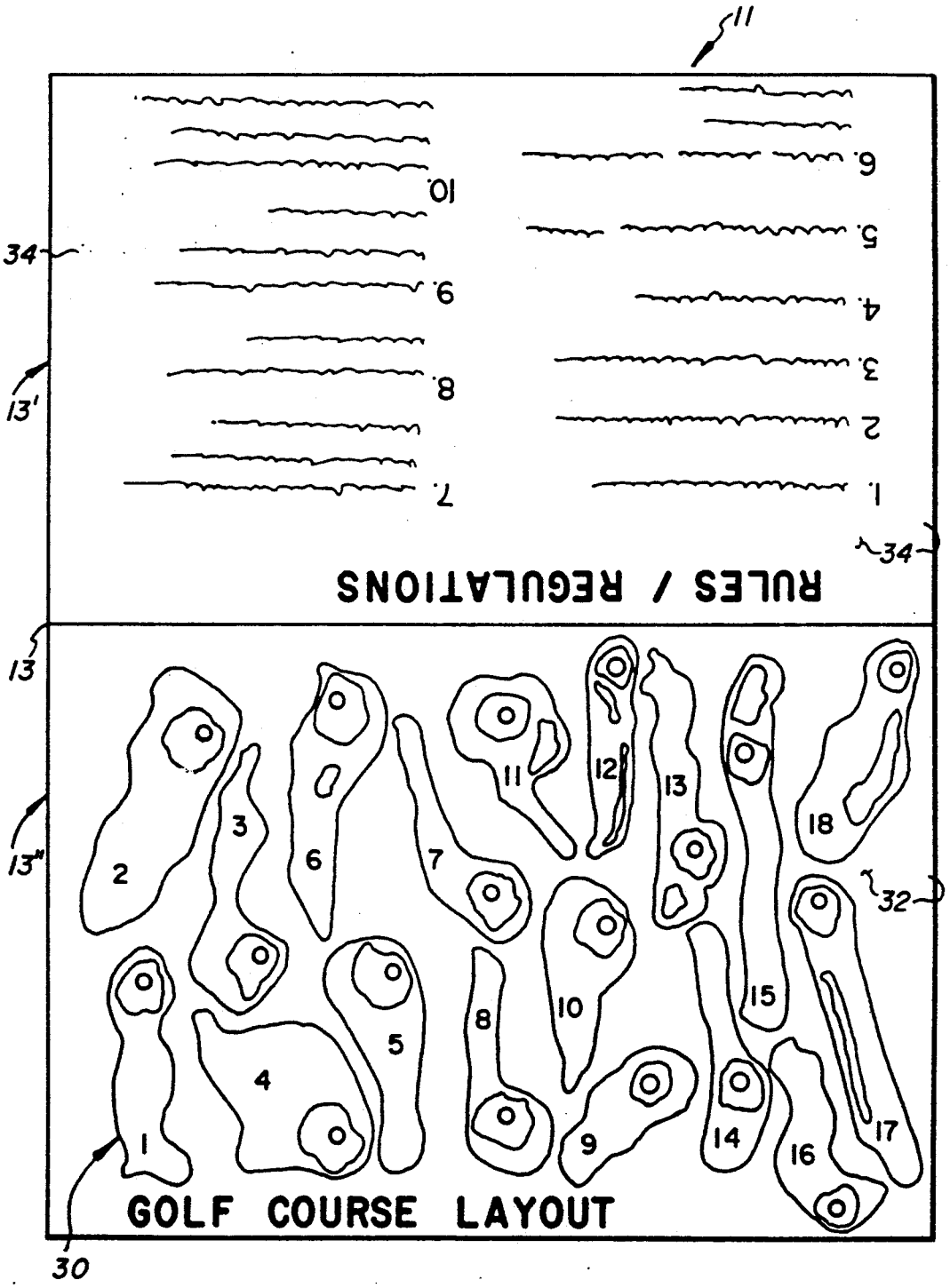
FIG. 4 is a plan view of the reverse side of the card of FIG. 3 showing exemplary printed reference information, which in this case is a layout of the particular golf course and the course rules.

Score card 11 is of conventional size and construction, and is preferably a panel of paper, cardboard, plastic and similar material which is conventionally employed in the construction of a record keeping cards such as golf score record cards. As shown in FIG. 3, score card 11 is preferably of double width size with a fold line 13 dividing it into two equal parts, 13' and 13''. In this way, score card 11 provides score recording area on both sides of card assembly 10. In the presently preferred embodiment of score card 11, it is noted that it has printed indicia 25 for recording golf scores on the first nine holes on the obverse side of part 13' and for recording golf scores for the last nine holes on the obverse side of part 13". There is also some free areas 26 for adding further indicia or information. The printed indicia is reversed on both sides so that card assembly 10 can be easily flipped from one part 13' to the other part 13". As depicted in FIG. 4, the reverse side of record card 11 has permanently printed information 30 that is comprised of the layout of the particular golf course on a panel 32 on part 13" and other indicia, such as the course rules, on a panel 34 on part 13'. Exemplary dimensions of a single part of score card 11 are 6 inches (15.2 cm) long by 4 inches (10.2 cm) wide.

Envelope 12 is preferably constructed of a transparent plastic film, or like materials, which can be constructed into a watertight envelope. Envelope 12 has a front panel 15 and a back panel 16 faced to each other and a watertight seal 17' sealing along three peripheral edge portions of said front panel 15 and back panel 16 along the two longer sides and one shorter side. Seal 17' defines an interior pocket 17 in envelope 12 which has a size and dimensions for removably containing record card 11 in it. An opening 18 is located at the other shorter side along the fourth edge portion to provide an access into said pocket 17. A watertight resealable seal 18' resealably seals opening 18. Exemplary type watertight resealable seals include the conventional "ZIP-LOC" seal and a zipper type seal. By locating opening 18 along the shorter side, there is less likelihood that it would be directly exposed to water than if it were located at the top, longer side.

An extension panel 19 extends from back panel 16, beyond the edge of front panel 15. Extension panel 19 is provided with an orifice 20 for holding a stylus that can be used to write scores, etc., and which can be an appropriate golf accessory such as a golf tee 23. In addition orifice 20 can be used to mount card assembly 10 on a golf cart between holes or on a rack for merchandizing. Envelope 12 has exemplary external dimensions, not including extension 19, of 6½ inches (16.5 cm) long by 4 ⅜ inches (11.1 cm) wide.

Figure 2:
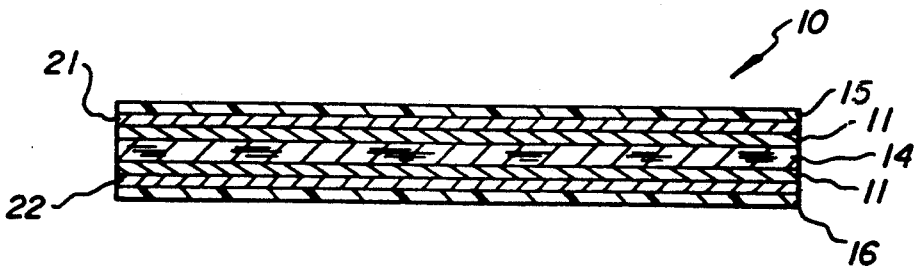
FIG. 2 is an enlarged view not necessarily to scale taken on the lines 2—2 of FIG. 1.

Referring to FIG. 2, a first, transparent glassine paper sheet 21 is located in pocket 17 between front panel 15 and the front half of card 11 and a second such paper sheet, denoted 22, is located in pocket 17 between back panel 16 and the back half of card 11. Glassine paper sheets 21 and 22 are a type of transparent carbonless paper such as that available under the trademark NCR paper from Appleton Papers of Appleton WI. One type of such carbonless paper is described in the aforementined Neubauer patent (in column 2), incorporated herein by reference. In addition to glassine, paper sheets 21 and 22 can also be made from CB coated cellophane, polyethyline and polyvinylchloride. Glassine paper sheets 21 and 22 are preferably of a size substantially equal to parts 13' and 13" of score card 11. Furthermore, paper sheets 21 and 22 are preferably part of a single large sheet of a size substantially equal to score card 11 as shown in FIGS. 3 and 4. Thus the large glassine paper sheet also is folded along a fold line (not shown) so as to cover both sides of card 11.

Alternatively, the inside surfaces of envelope 12 could be CB coated, thus eliminating the need of a separate sheet in assembly 10. However, most presently available CB-CF coating pairs have a large degradation in visability and marking quality between the first mark and the second mark over the same surfaces. If it is not desirable to reuse envelope 12, then this is not a problem, but it could result in increased costs of manufacture. For envelope 12 to be reusable, then a better quality CB-CF coating must be used.

A rigid, but lightweight, board 24 having substantially the same dimensions and shape as that of parts 13' and 13" of score card 11 is located between and abutting said folded card parts 13' and 13". Preferably, board 24 is constructed of cardboard, pressed fiberboard, wood, plastic (e.g., PVC plastics), and the like materials that are normally used to make a clip board or other writing support surface.

In use, a new score card 11 is folded over board 24 and a glassine paper sheet 21, 22 is folded over the top of score card 11. The assembly is then slidably inserted into transparent envelope 12 through opening 18. After the insertion, seal 18' is resealed or closed to provide a watertight seal. When a golf score needs to be recorded, a golf player uses a stylus tool such as golf tee 23 to write on the envelope in an appropriate area as indicated by the printed indicia on golf score card 11. A permanent image is formed on score card 11 as a result of the chemical reaction between the CB coating of glassine paper sheet 21 or 22 and the CF coating of golf score card 11. The now completely sealed watertight plastic film of envelope 12 protects the images formed on card 11, and card 11 itself, from moisture, dirt and grease.

Figure 5:
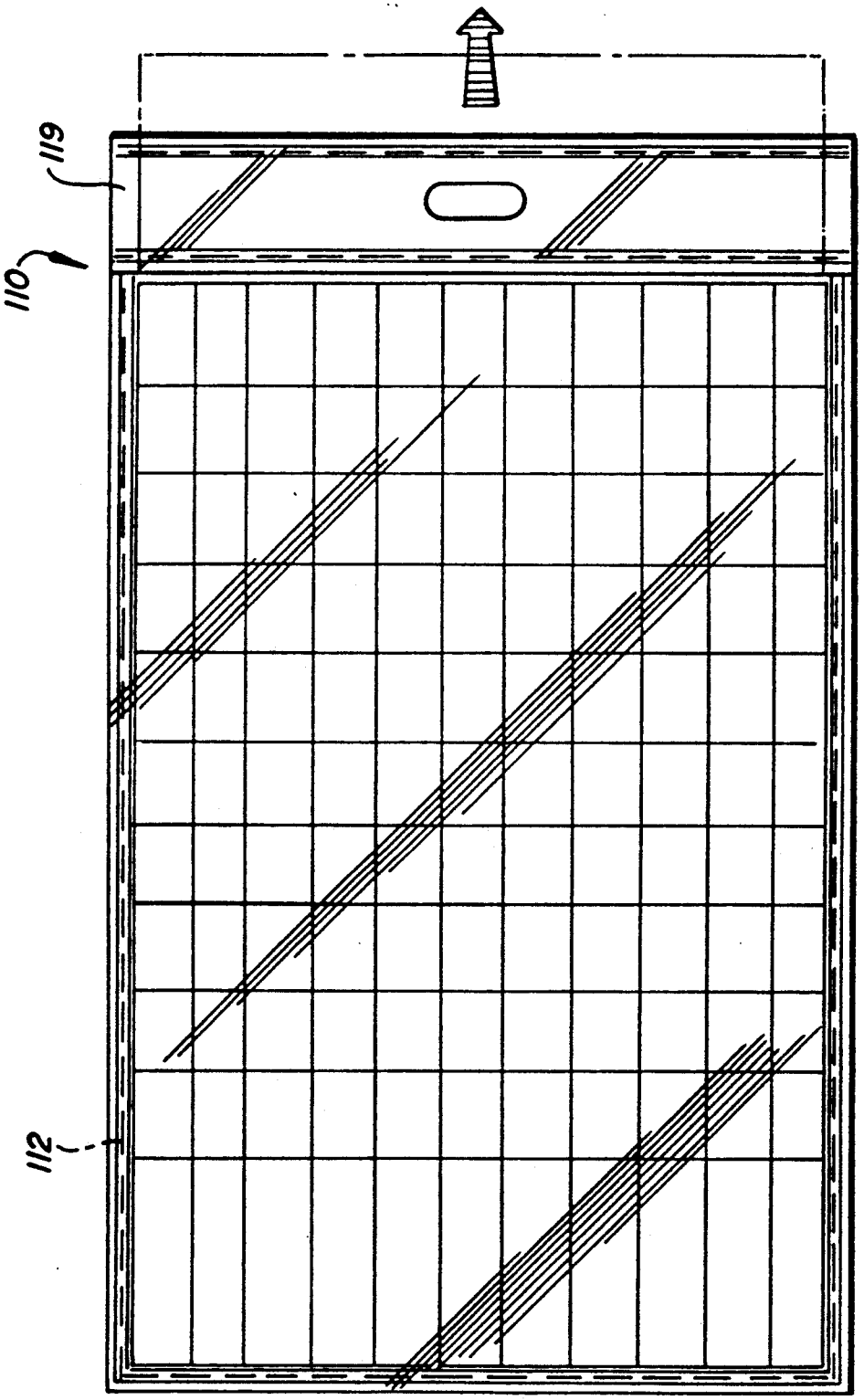
FIG. 5 is a plan view of another embodiment of the note card assembly.

In FIG. 5 there is depicted another embodiment of a card assembly, denoted 110, in accordance with the present invention. Card assembly 110 is also comprised of a watertight envelope 112 containing a score card 111. It can be seen that note card assembly 110 has an elongate shape and an extension part 119 located on one of the short sides of the envelope 112 instead of on the length thereof. However, card assembly 110 is similar to card assembly 10 in all other respects.

While a full and complete description of the invention has been set forth in accordance with the dictates of the patent statutes, it is to be understood that the invention is not intended to be limited to the specific form herein shown. Accordingly, modifications of the invention may be resorted to without departing from the spirit hereof or the scope of the appended claims.

I claim:

1. A watertight note card assembly comprising an envelope, said envelope having a front panel and a back panel a watertight seal sealing the edge portions of said front and back panel so as to define an interior pocket, an opening in said seal so as to permit across into said pocket, and a means for sealing said opening with a watertight seal, wherein at least a portion of at least one of said front and back panels is transparent;

a card having appropriate dimension and shape so as to be slidably insertable into said pocket through said opening, said card having a portion thereof for recording indicia; and means for making a visible mark on said card when a corresponding mark is made on said transparent panel.

2. The note card assembly as claimed in claim 1 wherein said mark making means comprises at least a first mark making paper having at least a portion thereof that is comprised of a transparent carbonless paper, said mark making paper having appropriate dimension and shape so as to be slidably insertable into said pocket between one side of said card and one of said front and back panels.

3. The note card assembly as claimed in claim 2 and further comprising a second mark making paper having at least a portion thereof that is comprised of a transparent carbonless paper, said second mark making paper having appropriate dimensions and shape so as to be slidably insertable into said pocket between the other side of said card and the other of said front and back panels; and wherein said card has indicia on both sides.

4. The note card assembly as claimed in claim 1 wherein said front panel and back panel of said envelope is made from a waterproof material, has an elongate shape and said card is a gold score card.

5. The note card assembly as claimed in claim 4 wherein the said golf score card is folded.

6. The note card assembly as claimed in claim 5 wherein the said indicia of the golf score card is reversed on both sides.

7. The note card assembly as claimed in claim 5 further comprising a rigid board having dimensions and shape so as to be locatable next to the other side of said card and locatable between said folded card sides.

8. The note card assembly as claimed in claim 1 further comprising a rigid board having dimensions and shape so as to be locatable next to the other side of said card.

9. The note card assembly as claimed in claim 2 wherein said mark making paper comprises a single piece that is folded so as to cover both sides of said card.

10. The note card assembly as claimed in claim 1 wherein said mark making means is in said pocket and comprises a first and a second piece of transparent carbonless paper, each piece of said paper covering one side of said card.

11. The note card assembly as claimed in claim 1 wherein said envelope is permanently sealed along three edges thereof.

12. The note card assembly as claimed in claim 11 wherein said opening sealing means is resealable.

13. The note card assembly as claimed in claim 1 wherein there is an extension on at least one side of said back panel that extends beyond the corresponding side of said front panel.

14. The note card assembly as claimed in claim 13 wherein said extension has at least one orifice for holding an appropriate accessory used to make marks on said card.

15. The note card assembly as claimed in claim 1 wherein said card has permanent indicia on it and also has some free spaces to add further indicia or information.

16. The note card assembly as claimed in claim 15 wherein said permanent indicia is for recording golf scores.

17. The note card assembly as claimed in claim 1 and further comprising an implement for making an impression on said panel adjacent that side of said card on which indicia is to be recorded and thereby making a mark on said card.

18. The note card assembly as claimed in claim 17 wherein said implement comprises a golf tee.

19. A waterproof note card assembly comprising a transparent envelope, said envelope having a front panel and a back panel made from a waterproof material, a watertight seal permanently sealing the edge portions of said front and back panel so as to define an interior pocket, and an opening in said seal so as to be permit access into said pocket;

a card having appropriate dimension and shape so that said envelope can be placed over said card through said opening and said pocket receives said card, said card having permanent indicia thereon and some free space to add further indicia or information; and means in said pocket for making a visible mark on said card when a corresponding mark is made on said panel.

20. A waterproof note card assembly as claimed in claim 19 wherein said mark making means comprises a transparent carbonless paper having appropriate dimensions and shape so as to be slidably insertable into said pocket and so as to permit the insertion of said card, and wherein said carbonless paper has one of a CB of CF coating thereon and said card has the other of said CB or CF coating thereon.

* * * * *